US005473127A

United States Patent [19]

Falcon et al.

[11] Patent Number: 5,473,127

[45] Date of Patent: Dec. 5, 1995

[54] INTERLOCK MECHANISM FOR A KEY OPERATED DOOR SWITCH

[75] Inventors: David E. Falcon, Oak Creek, Wis.; Michael J. Tresemer, Kent, Ill.

[73] Assignee: Honeywell Inc., Minneapolis, Minn.

[21] Appl. No.: 394,681

[22] Filed: Feb. 24, 1995

[51] Int. Cl.[6] ..... H01H 27/00

[52] U.S. Cl. ..... 200/43.04; 200/43.01; 200/43.02; 70/DIG. 30

[58] Field of Search ..... 200/43.04, 43.01, 200/43.02, 43.07, 43.08, 43.09, 50 A, 61.62, 61.7, 61.72, 61.73; 70/DIG. 30

[56] References Cited

U.S. PATENT DOCUMENTS

| | | | |
|---|---|---|---|
| 3,858,018 | 12/1974 | Walley | 200/43.07 |
| 4,395,608 | 7/1983 | Eicker et al. | 200/43.04 |
| 4,454,392 | 6/1984 | Rapp et al. | 200/61.67 |
| 4,524,251 | 6/1985 | Schulz | 200/43.07 |
| 4,658,102 | 4/1987 | Seim et al. | 200/61.62 |
| 4,695,684 | 9/1987 | Bochard et al. | 200/43.07 |
| 4,904,829 | 2/1990 | Berthaud et al. | 200/50 |

*Primary Examiner*—William A. Cuchlinski, Jr,
*Assistant Examiner*—David J. Welczak
*Attorney, Agent, or Firm*—Lanyi: William D.

[57] ABSTRACT

A key operated door interlock switch is provided with a cam structure having a first cam and a second cam connected together for rotation about a first axis. A key is shaped to have first and second actuator portions that can be moved into a switch housing to engage first and second lobes of the first and second cams. The first and second actuator portions of the key engage the lobes sequentially to rotate the cam mechanism about the first axis. Rotation of the cam mechanism causes a plunger to move linearly relative to the support structure and operate an electrical switch that permits associated equipment, such as machinery to be actuated. The relative lengths of the first and second actuator portions of the key can be selected to match the arcuate displacement of the lobes of the cams relative to the first axis. This flexibility allows the switch to be customized so that only particular keys can actuate particular switches even though their general appearance is similar.

20 Claims, 7 Drawing Sheets

INTERLOCK MECHANISM FOR A KEY OPERATED DOOR SWITCH

BACKGROUND OF THE INVENTION

1. Field of the Invention

The present invention is generally related to a key operated door interlock switch mechanism and, more particularly, to an interlock switch that utilizes a cam structure comprising two cams that interact with a key that comprises two actuator portions.

2. Description of the Prior Art

Many different types of key interlock switches are known to those skilled in the art. Interlock switches can be used to assure that a certain condition is satisfied before a machine is permitted to operate. For example, a protective door may be employed to prevent a human operator from being harmed during the operation of a machine. To assure that the arms or hands of an operator are not within a dangerous zone of a machine during its activation, a switch is often incorporated as part of the protective door and the switch prevents the machine from being operated unless the door is closed. As an example, a key may be attached to the movable portion of a door and an associated switch structure can be associated with the stationary part of the protective housing around a machine.

Many types of door interlock switches are susceptible to human interference or tampering. In other words, an operator may take steps to either disarm the protective mechanism or defeat its protective characteristics. Many different types of door interlock switches have been developed to discourage or completely prevent this type of tampering.

Berthaud et al U.S. Pat. No. 4,904,829, which issued on Feb. 27, 1990, discloses an actuator controlled key lock switch that attaches a key to the door of an electrical equipment cubical. The key is capable of sliding within a passage way to as to cause pivotable displacement of a cam and upward displacement of a push rod, thus releasing a switch lug. A locking rod forming part of a slide block which is coupled with the push rod is capable of moving between a locking position in which an annular channel permits displacement of the key and an unlocking position in which the locking rod is engaged within a key notch. One end of the slide block projects from the top face of the switching unit head in order to be downwardly displaced by an actuator, where upon the key can be withdrawn without difficulty or danger.

Rapp et al U.S. Pat. No. 4,454,392, which issued on Jun. 12, 1984, describes a safety switch that comprises a drive and locking device. A key is used to operate the drive. The drive comprises a ram longitudinally moved by the key. The locking device includes a blocking member for the ram which can only be released by the key.

Bochard et al U.S. Pat. No. 4,695,684, which issued on Sep. 22, 1987, discloses an electric safety switch that can only be actuated by means of a key carried by a movable part of an installation. With its ramp, the key causes retraction of a bolt which is carried by a dividing wall of a rotary sector and, with its finger causes the angular driving of a groove of this dividing wall, the latter element entirely covering the cam surfaces which actuate the switch pusher. These switches are advantageously used in installation such as elevators and in safety circuits associated with cabinet doors.

Eicker et al U.S. Pat. No. 4,395,608, which issued on Jul. 26, 1983, describes a safety switch assembly in which an electrical interlock comprises a switch that is operated by a rotatable cam member coupled to the movable switch contacts by a longitudinally movable slider. Rotation of the cam member, which is contained within the same housing as the switch contacts, is caused by engagement, in slots in the periphery of the cam member, of an actuator mounted for movement relative to the switch housing.

Interlock switches, by their nature, must be sufficiently sophisticated to inhibit tampering. However, this level of sophistication often increases the manufacturing and assembly costs of the switch. It would therefore be significantly beneficial if an interlock switch could be provided which is appropriately sophisticated for the purpose of defeating an attempt to tamper with the switch, but able to be manufactured at a reduced cost. In addition, it would be advantageous if a switch of this type were able to be made in such a way that minor alterations to the switch, during manufacturing, could discriminate between various keys of generally similar design. This feature would enable the interlock switches to operate in the manner of normal door locks wherein a particular switch could only be operated by a particular key even though the general operation and interrelationship between the locks and keys are generally similar in all cases.

SUMMARY OF THE INVENTION

An interlock switch made in accordance with the present invention comprises a key which has a first actuator portion and a second actuator portion. In addition, a support structure is provided in which a cam structure is disposed. The cam structure has a first cam and a second cam and each of the two cams has an associated lobe. The cam structure is support by the support structure for rotation about a first axis. The first and second cams are attached together for rotation about the first axis. The first lobe is shaped to receive an end of the first actuator portion of the key and the second lobe is shaped to receive an end of the second actuator portion of the key. The first and second cams are rotatable about the first axis. The first and second lobes are rotatably offset relative to each other and relative to the first axis. Throughout the Description of the Preferred Embodiment of the present invention, its structure will be described as having a first cam and a second cam and, in addition, a first cam follower and a second cam follower. However, it should be clearly understood that the provision of a third cam and a third cam follower is within the scope of the present invention. In addition, providing a key that has a third actuator portion shaped to conform with the third cam is also within the scope of the present invention. The addition of a third cam, a third cam follower and a third actuator portion of the key merely expands on the advantages of the present invention.

In addition, a preferred embodiment of the present invention comprises first and second cam followers that are rotatably attached to the support structure. The first cam follower is shaped to be received by the first lobe of the first cam and the first cam is prevented from rotating about the first axis when the first cam follower is disposed within the first lobe. Similarly, the second cam follower is rotatable attached to the support structure and shaped to be received by the second lobe. The second cam is prevented from rotating about the first axis when the second cam follower is disposed within the second lobe.

First and second means are provided for preventing the associated cam followers from moving into their associated lobes. In other words, the first preventing means is provided for preventing the first cam follower from moving into the first lobe when the end of the first actuator portion of the key is disposed within the first lobe. Similarly, the second preventing means is provided for preventing the second cam follower from moving into the second lobe when the end of the second actuator portion of the key is disposed within the second lobe. A means is provided for actuating an electrical switch when the cam structure is rotated about the first axis by a predetermined arcuate distance.

In a particularly preferred embodiment of the present invention, the first and second actuator portions of the key are of different lengths. The magnitude of the difference in length between the first and second actuator portions of the key can be used to discriminate one key from another and enable the support structures and associated cam elements to distinguish between the insertion of one key and the insertion of another key which has actuator portions that differ in length by a different amount.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
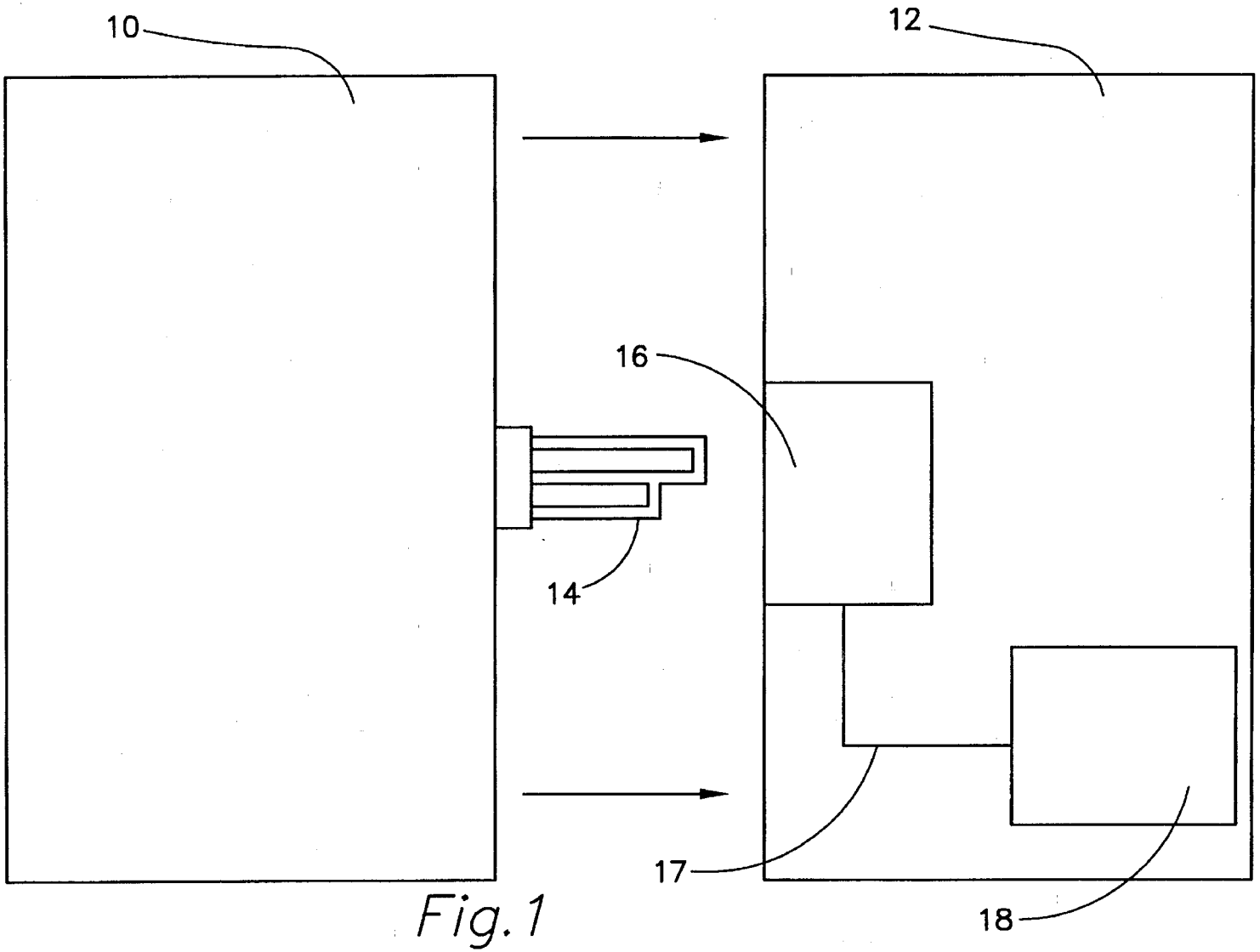
FIG. 1 illustrates a typical application of a door interlock switch.

Throughout the Description of the Preferred Embodiment, like reference numerals will be used to identify like components.

FIG. 1 illustrates a basic arrangement of a movable door 10 and a stationary portion 12 of a protective cubicle or housing that is disposed around a potentially dangerous machine. A key 14 is attached to the door 10 and a housing, or support structure 16, is attached to the stationary portion 12. When the door 10 is moved into contact with the stationary portion 12, the key 14 is inserted into a receiving portion of the support structure 16. If the key is properly inserted into the support structure, a mechanical interlock within the support structure is properly actuated and a signal is provided, on line 17, to some type of appropriate control circuitry 18 that enables a machine to be operated. If the key 14 is not properly inserted into the support structure 16, the control circuitry 18 is not provided with the proper signal that causes it to permit the machine to be operated. In this manner, a key interlock switch can be used as a safety mechanism to prevent injury from occurring to an operator.

Figure 2:
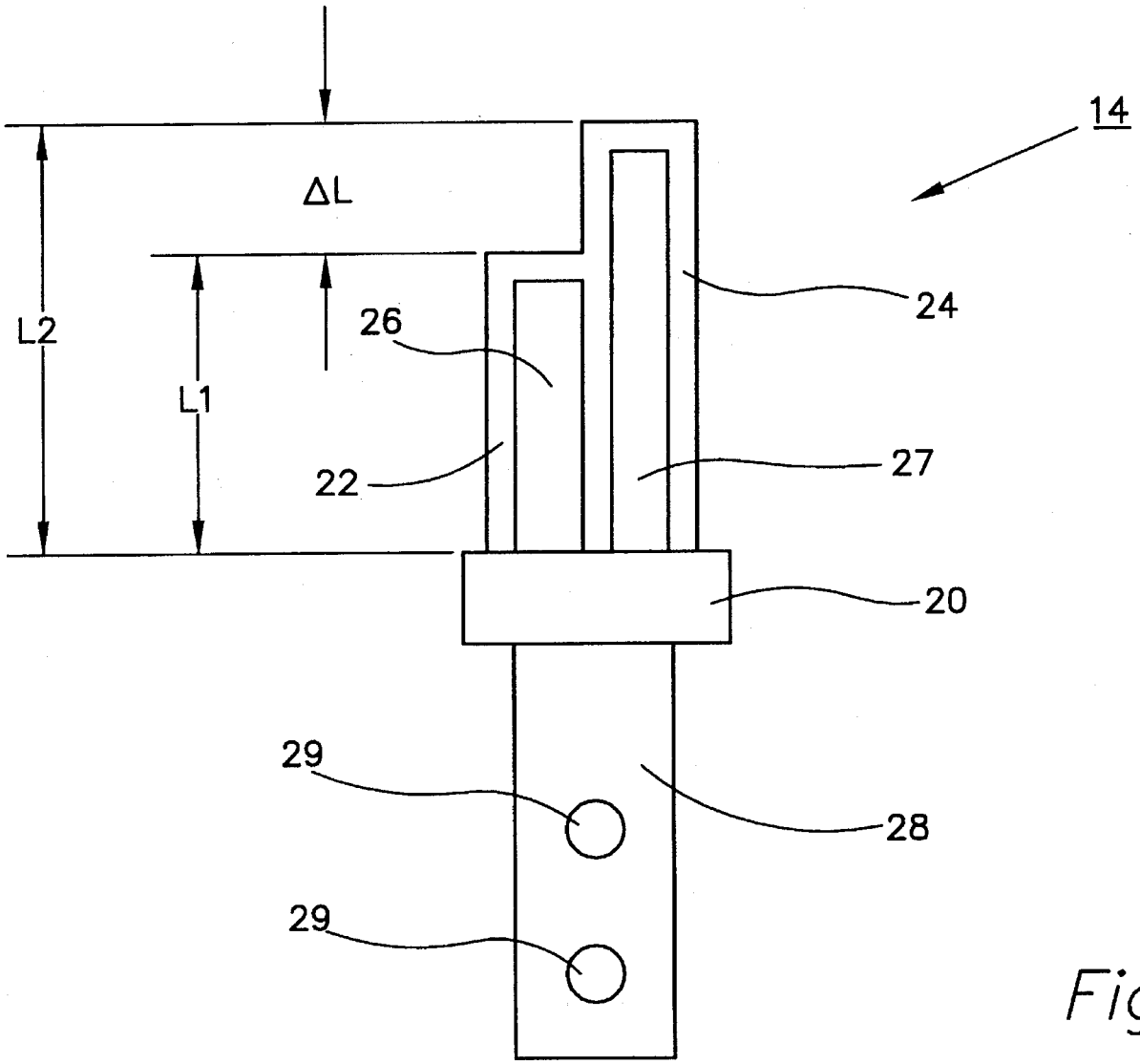
FIG. 2 is a plan view of a key made in accordance with the present invention.

Although many different types of keys are known to those skilled in the art, FIG. 2 shows a key which is particularly suitable for use in conjunction with the present invention. The key 14 comprises a first actuator portion 22 and a second actuator portion 24. The first actuator portion 22 has an opening 26 formed therein and the second actuator portion 24 has an opening 27 formed therein. The first and second actuator portions, 22 and 24, extend from a body 20 of the key. Also extending from the body of the key is a tongue 28. The tongue 28 is provided with two holes 29 that enable the key 14 to be rigidly attached to a door such as that which is identified by reference numeral 10 in FIG. 1.

With continued reference to FIG. 2, it can be seen that the first actuator portion 22 has an effective length L1 that is shorter than the effective length L2 of the second actuator portion 24. The difference in these lengths of the first and second actuator portions is identified as $\Delta L$. As will be described in greater detail below, the magnitude of $\Delta L$ can be used to distinguish one key from another even though they are made in a generally similar shape.

Figure 3:
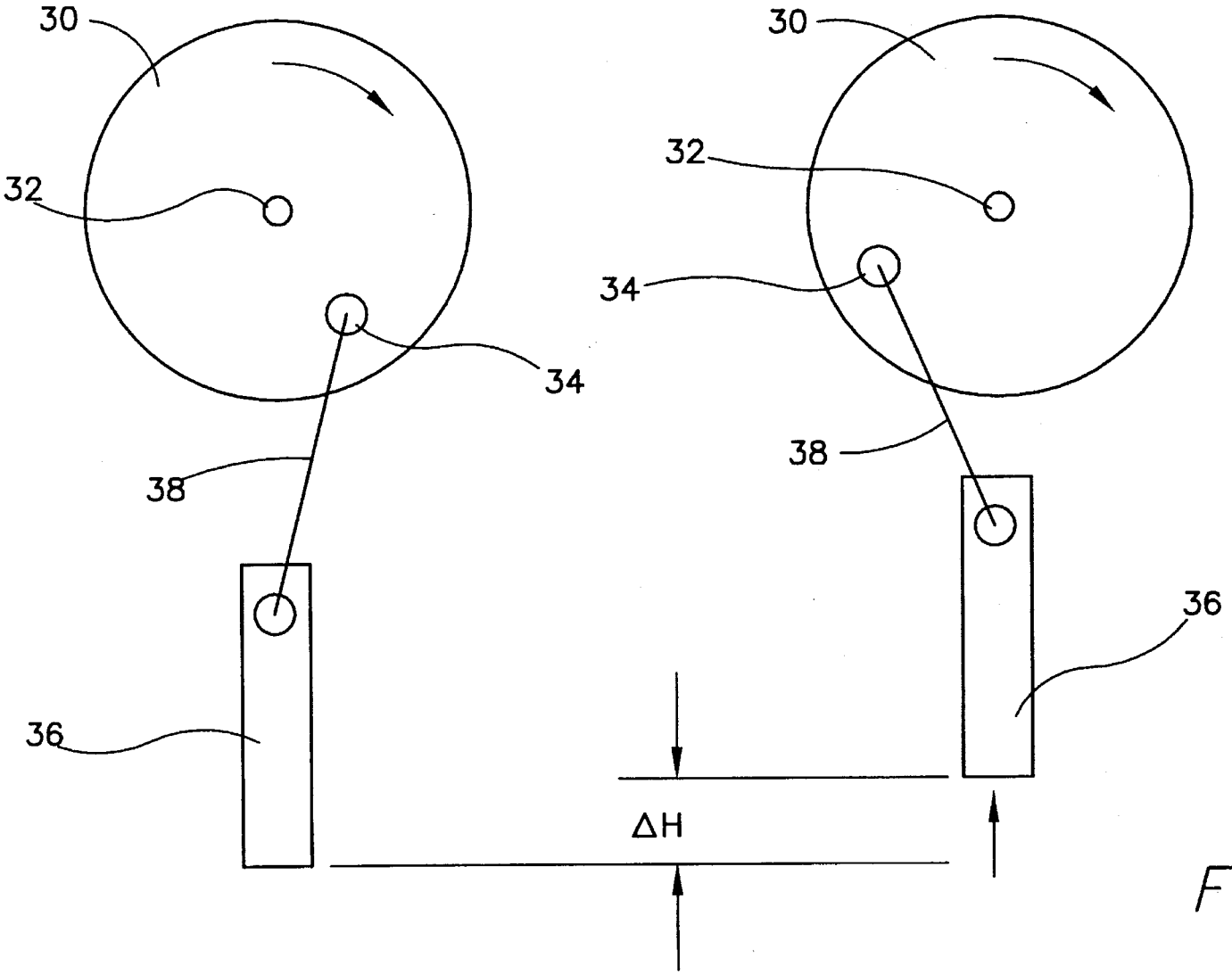
FIG. 3 is a highly schematic representation showing the mechanical movement of a rotatable member, a plunger and an associated linkage arm.

FIG. 3 is a highly schematic representation which is intended to illustrate the general operation of the present invention when the appropriate key is inserted into the support structure and a cam structure is rotated about a first axis. FIG. 3 shows two representations of a mechanical structure in two sequential conditions. On the left portion of FIG. 3, a rotatable member 30 is disposed for rotation about a first axis 32. A pin 34 is attached to the rotatable member 30. A plunger 36 is arranged to move in an upward and downward direction and the plunger 36 is attached to the pin 34 by a linkage arm 38. When the rotatable member 30 rotates in a clockwise direction, the pin 34 moves to the position shown in the right illustration of FIG. 3 and, because of the connection of the linkage arm 38, the plunger 36 is caused to move upward. This difference in position of the plunger 36 is identified as $\Delta H$. This upward movement of the plunger 36 can be advantageously used to actuate or deactuate an electrical switch. It should be understood that the illustration in FIG. 3 is highly schematic and has been simplified to illustrate the basic mechanical movement of a cam structure of the present invention and a related plunger.

Figure 4:
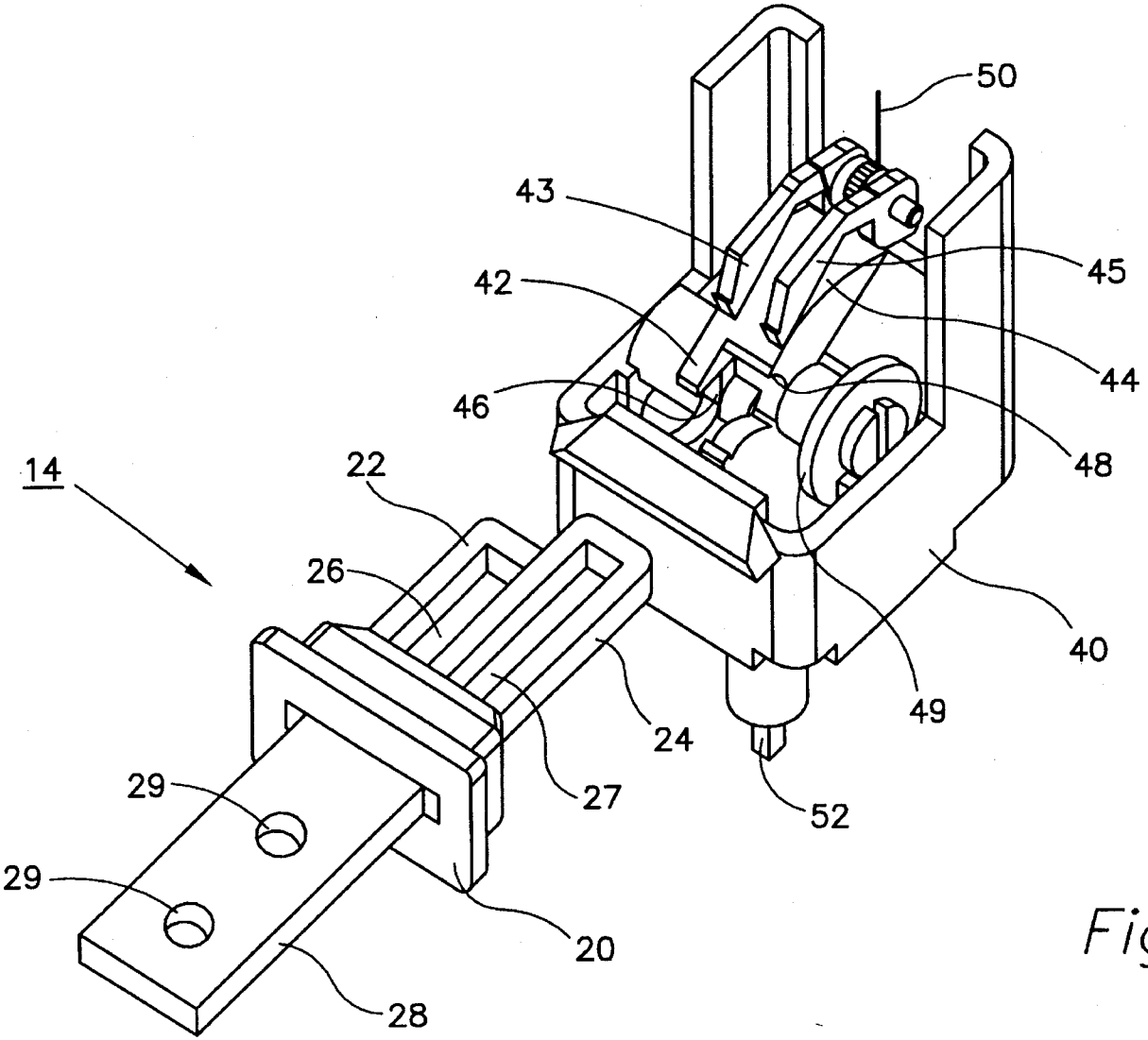
FIG. 4 is a perspective view of a key and switch mechanism made in accordance with the present invention.

FIG. 4 is a perspective view showing a key 14 and a support structure 40. It should be understood that, for purposes of clarity, the upper portion of the support structure 40, or housing, is not shown in FIG. 4. A cam structure is rotatably attached to the support structure 40 and comprises a first cam 42 and a second cam 44. The cam structure can be formed as a unitary element or, alternatively, the first and second cams can be rigidly attached together. Regardless of the exact means for providing the cam structure, the first and second cams should be arranged so that they rotate together about the first axis. The first cam 42 has a first lobe 46 while the second cam 44 has a second lobe 48.

With continued reference to FIG. 4, a first cam follower 43 is associated with the first cam 42 and its first lobe 46. Similarly, a second cam follower 45 is associated with the second cam 44 and its second cam lobe 48. A spring mechanism 49 is associated with the cam structure to urge it to remain in a preferred position which will be described in greater detail below. A spring 50 is provided to urge the first and second cam followers in a generally downward direction toward their associated cams. A plunger 52 extends downward from the support structure 40 and is associated with the support structure so that it can move upward and downward in response to rotation of the cam structure. When the key 14 is moved into an opening formed in the support structure 40, the first and second actuator portions, 22 and 24, cause the first and second cams, 42 and 44, to rotate about the first axis. If the first and second actuator portions of the key 14 are of the proper shape and relative length, the cam structure will receive the key and permit the first and second cams to rotate against the resistence provided by the spring mechanism 49. In addition, the ends of the first and second actuator portions, 22 and 24, will prevent the first and second cam followers, 43 and 45, from locking the cams in a way that will prevent their further rotation.

Figure 5:
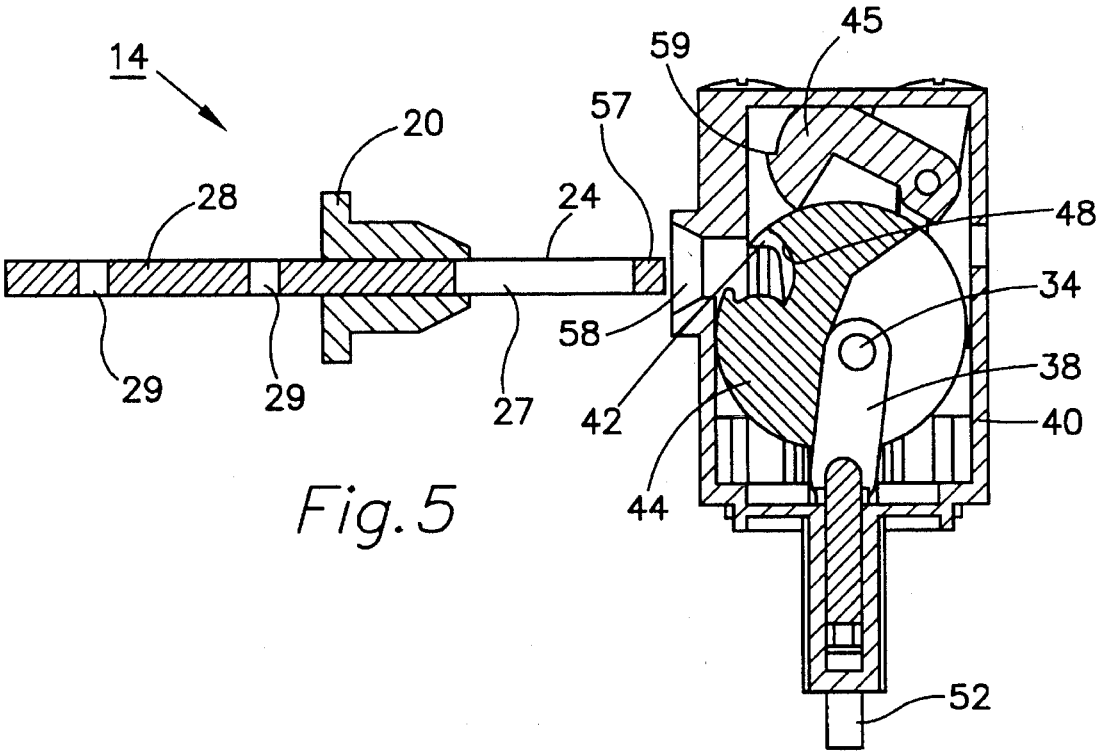
FIG. 5 is a side sectioned view of the present invention.

FIG. 5 is a sectioned side view of the structure shown in FIG. 4. Since the second actuator portion 24 is longer than the first actuator portion 22 in FIG. 4, the section view shows the structure of the second actuator portion 24 because it is the portion whose end will initially enter the support structure 40. The key 14 is shown in FIG. 5 prior to entry through an opening 58 in the housing, or support structure 40. The view of FIG. 5 also shows the second lobe 48 formed in the second cam 44. As the key 14 is inserted into the support structure 40, its end 57 can move into contact with the lobe 48 of the second cam 44. Upon initial contact of the end 57 of the second actuator portion 24, the first cam 44 will begin to rotate in a clockwise direction about its first axis which is its center of rotation.

Figure 6:
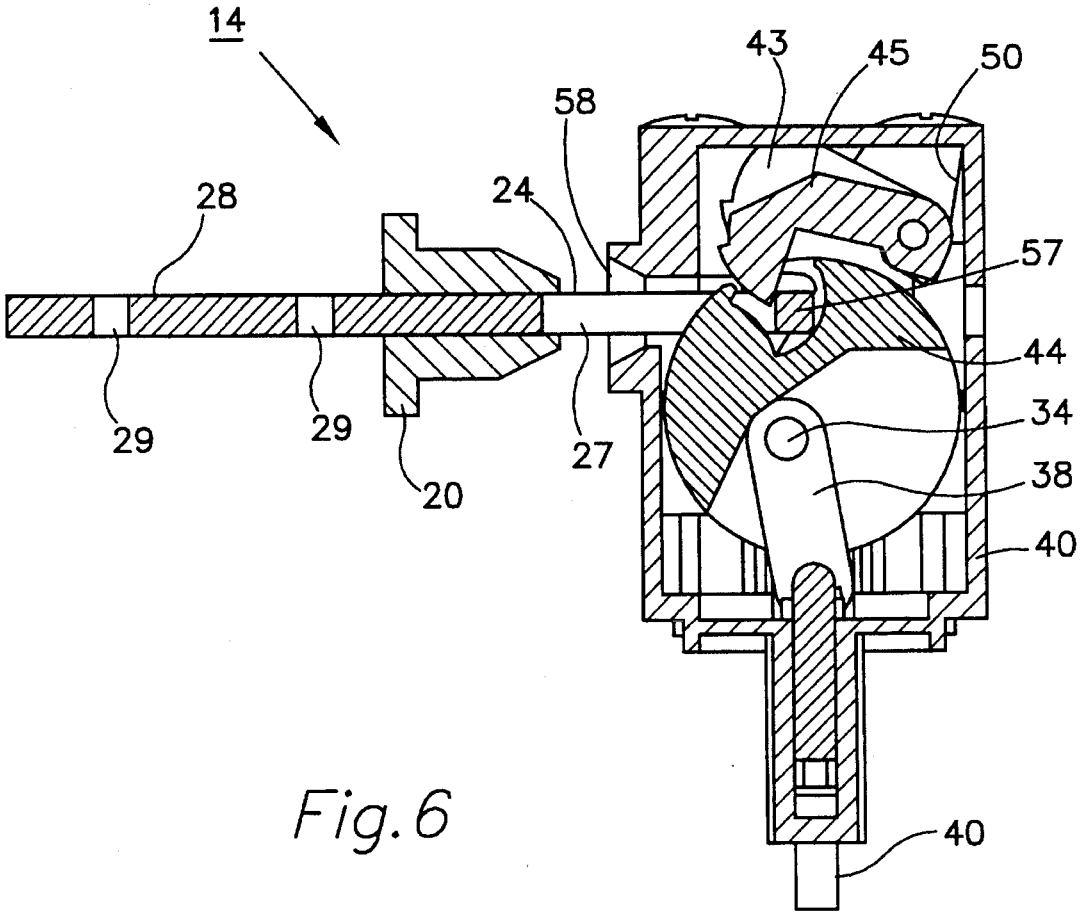
FIG. 6 is a side section view of the mechanism of the present invention with a key partially inserted into a support structure, or housing.

FIG. 6 illustrates the arrangement of FIG. 5 after the key 14 has been inserted into the support structure 44. Because of the contact of the end 57 and the lobe 48, the second cam 44 is urged in a clockwise direction about its central axis of rotation. In FIG. 6, it can be seen that the end 57 of the second actuator portion 24 prevents the second cam follower 45 from dropping completely down into the second lobe 48. The second cam follower 45 is prevented from moving downward into the second lobe 48 even though spring 50 urges it in that preferred direction.

With reference to FIGS. 5 and 6, it can be seen that a partial insertion of the key 14 into the support structure 40 actually causes the plunger 52 to move slightly downward. It should be clearly understood that the actuating position of the present invention is when the plunger 52 is retracted in an upward direction toward the first axis of rotation of the cam structure. Therefore, the partial insertion represented by FIG. 6 actually moves the plunger 52 in a direction away from that which would permit the actuation of associated machinery. Because of the position of pin 34 in FIG. 5, slightly to the right of the center of rotation, or first axis, of the cam structure, the initial clockwise rotation of the first and second cams must first move the plunger 52 downward which is toward a position wherein associated machinery is continually inhibited from operation. For example, if an actuated snap switch is associated with the plunger 52, the downward movement of the plunger 52 would further actuate the switch and continue to prevent any operation of the associated machinery. When the key 14 is further inserted into the support structure 40, continued clockwise rotation of the cam structure will move pin 34 which will eventually cause plunger 52 to move upward toward the center of rotation of the cam structure and the associated electrical switch will therefore permit the machinery to be operated after complete insertion of the key 14 into the support structure 40.

With reference to FIGS. 4 and 6, it can be seen that when the second actuator portion 24 is partially inserted into the support structure 40 and its end 57 is engaged with the second lobe 48 as shown in FIG. 6, the first actuator portion 22 of the key 14 will begin to engage with the first lobe 46 of the first cam 42. Although it is difficult to show this dual engagement in a single illustration, it can be seen that this dual engagement will occur by viewing FIGS. 4 and 6. In a manner similar to that described above, the end of the first actuator portion 22 of the key 14 will similarly prevent the first cam follower 43 from dropping down into the first lobe 46 even though spring 50 urges it in that direction. Therefore, the size and shape of both actuator portions of the key, in combination with the size and shape of the first and second cams and their lobes, allow the key 14 to be inserted completely into the support structure 40 while the cam followers, 43 and 45, are prevented from dropping downward into their associated lobes. This cooperation of the components allows the key 14 to be inserted completely into the support structure 40 and also allows the plunger 52 to be raised so that the associated machinery can be actuated.

Figure 7:
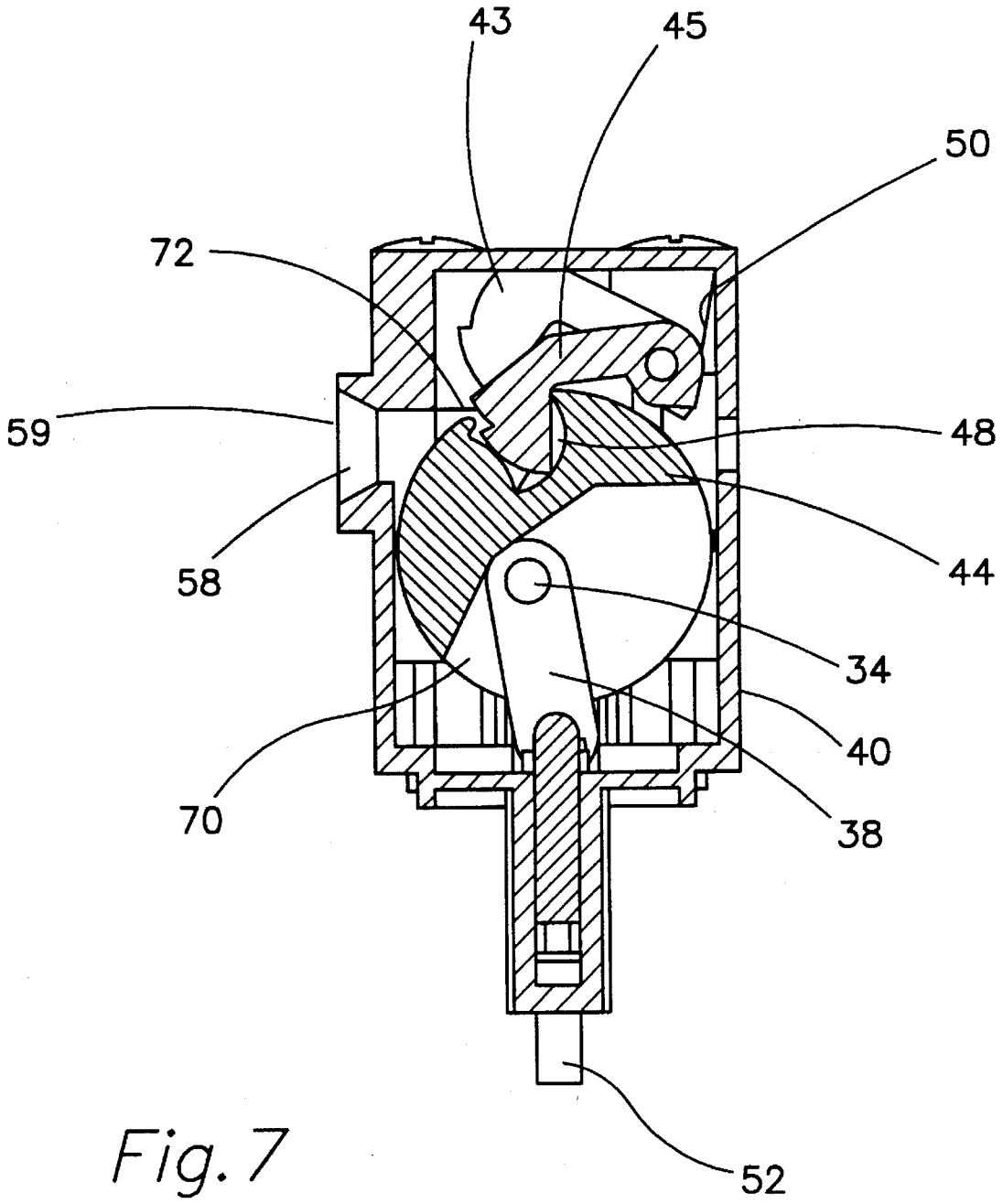
FIG. 7 is a side section view of the present invention showing its ability to prevent rotation of a cam structure when the proper key is not used.

For purposes of illustrating the operation of the present invention when an improper means, other than the key 14, is used in an attempt to rotate the cam structure 70 about its first axis, FIG. 7 shows the cam structure 70 rotated about its centerline without the presence of the key. As can be seen in FIG. 7, the second cam follower 45 has dropped down into the second lobe 48 of the second cam 44. This results from the force provided by spring 50. Because of the shape of the second cam follower 45, with its edge 59 that is also illustrated in FIG. 5, further clockwise rotation of the cam structure 70 is prevented because of the interaction of the edge 59 with the portion 72 of the lobe 48. These shapes will interfere with each other and prevent further clockwise rotation of the cam structure 70. Therefore, without the end 57 of the second actuator portion 24 being disposed within the lobe 48, the cam follower 45 is able to prevent this additional rotation. The circumstance shown in FIG. 7 therefore provides a safety lockout that prohibits plunger 52 from being raised beyond its position in FIG. 7 as a result of an attempted tampering with the device without the key 14 being used.

Figure 8:
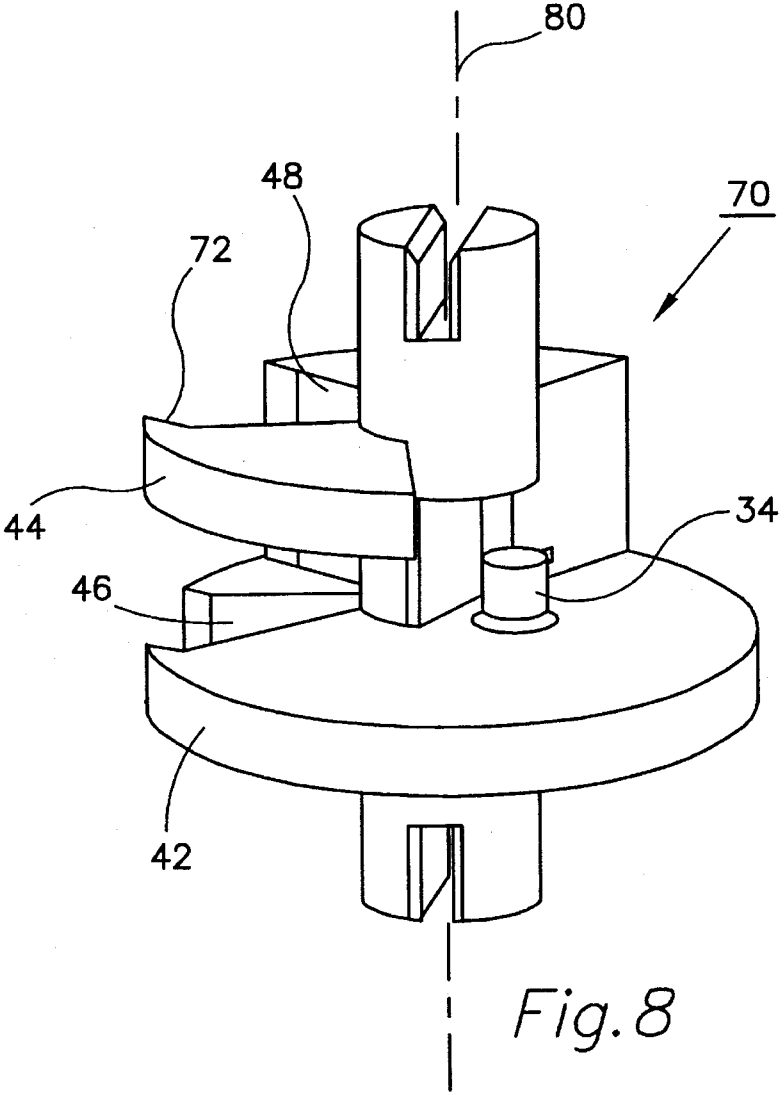

FIG. 8 illustrates the cam structure 70 removed from the other components contained within the support structure 40. In FIG. 8, the first cam 42 is shown with its first lobe 46 and the second cam 44 is shown with its second lobe 48 and the portion 72 that interacts with the edge 59 of the cam follower described above in conjunction with FIG. 7. The first axis 80 is the axis of rotation about which the cam structure rotates relative to the support structure 40. Pin 34 is shown in its position attached to the first cam 42. When assembled into the support structure 40, pin 34 is operatively associated with linkage arm 38 as described above.

Figure 9:
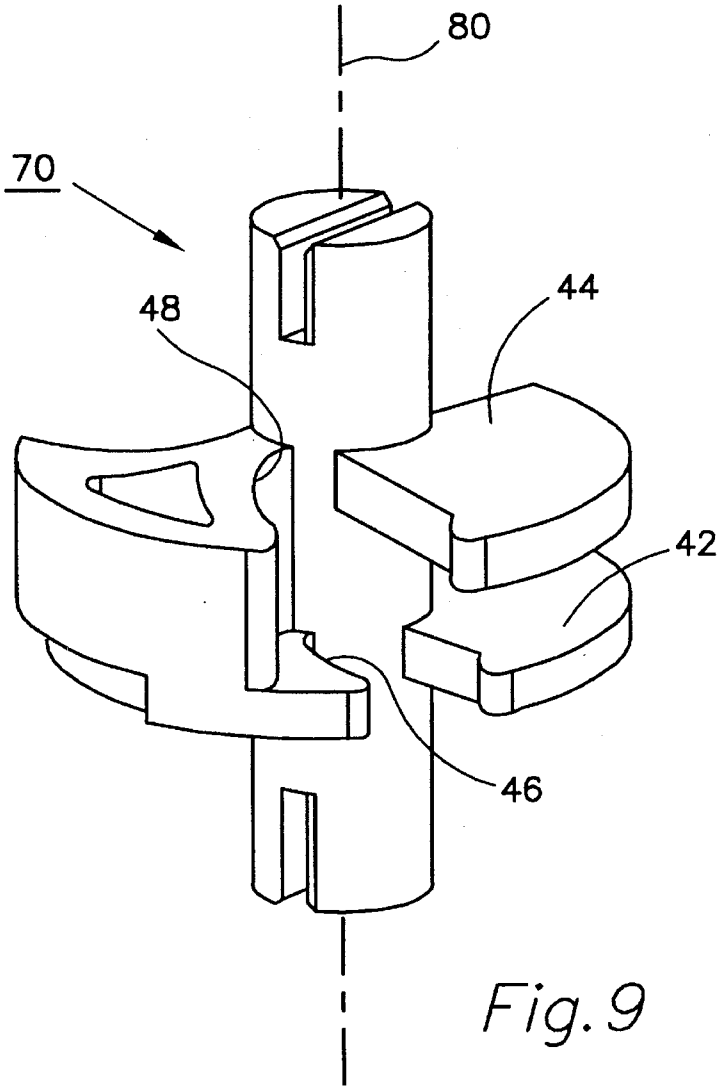
FIGS. 8 and 9 show two perspective view of a cam structure of the present invention.

FIG. 9 illustrates another view of the cam structure 70 that is shown in FIG. 8. With reference to FIGS. 8 and 9, the relative positions of the first and second cams, 42 and 44, and the first and second lobes, 46 and 48, can be seen. The first axis 80 is shown extending through an axial portion of the cam structure that is operatively associated with the spring mechanism 49 described above in conjunction with FIG. 4.

The primary advantages of the present invention are that movement of the plunger 52 can be inhibited unless the proper key 14 is used in association with a particular cam structure and, in addition, that two actuator portions of the key are required to rotate the cam structure about its first axis 80. In order to tamper with the switch made in accordance with the present invention, both cam followers, 43 and 45, have to be retained in their position against the force of spring 50 while the first and second cams are moved in a clockwise direction. If either of the cam followers is permitted to drop down into its associated lobe, further movement is prevented. An additional advantage of the present invention is that the relative lengths of the first and second actuator portions, 22 and 24, can be altered to allow certain switches to be actuated only by certain matching keys. This prevents the possibility of a tamperer from using a spare key from another machine to improperly actuate a switch even though the associated protective door is opened. Therefore, keys of many different combinations of actuator portion lengths can be provided in a factory where many different machines are used. Variation of the lengths of the first and second actuator portions can effectively provide many different key and switch combinations that individualize the safety mechanisms from machine to machine. As should be apparent from the above description, the cam structure is manufactured so that the arcuate displacement of the first and second lobes matches the difference in length between the first and second actuator portions of the key. Therefore, the configuration of the key can provide many different possible combinations of lengths of the actuator portions and associated changes in the arcuate displacement of the first and second cams of the cam structure can be made to match these combinations. This provides the individualization described above.

The embodiments of the invention in which an exclusive property or right is claimed are defined as follows:

1. An interlock switch mechanism, comprising:

a key having a first actuator portion and a second actuator portion having a different length than said first actuator portion;

a support structure;

a cam structure having a first cam and a second cam, said first cam having a first lobe, said first cam being rotatably attached to said support structure, said first cam being rotatable about a first axis, said first lobe being shaped to receive an end of said first actuator portion, said second cam having a second lobe, said second cam being rotatably attached to said support structure, said second cam being rotatable about said first axis, said first and second cams being attached to each other, said first and second lobes being rotatably offset relative to each other, said second lobe being shaped to receive an end of said second actuator portion, said cam structure being rotatable about said first axis in response to contact of said end of said second actuator portion with said second lobe and in response to contact of said end of said first actuator portion with said first lobe;

a first cam follower rotatably attached to said support structure, said first cam follower being shaped to be received by said first lobe, said first cam being prevented from rotating about said first axis when said first cam follower is disposed within said first lobe;

a second cam follower rotatably attached to said support structure, said second cam follower being shaped to be received by said second lobe, said second cam being prevented from rotating about said first axis when said second cam follower is disposed within said second lobe;

first means for preventing said first cam follower from moving into said first lobe when said end of said first actuator portion is disposed within said first lobe;

second means for preventing said second cam follower from moving into said second lobe when said end of said second actuator portion is disposed within said second lobe; and means for actuating an electrical switch when said cam structure is rotated about said first axis by a predetermined arcuate distance.

2. The switch mechanism of claim 1, wherein:

said second actuator portion is longer than said first actuator portion.

3. The switch mechanism of claim 1, wherein:

said first lobe is an opening formed in said first cam.

4. The switch mechanism of claim 1, wherein:

said second lobe is an opening formed in said second cam.

5. The switch mechanism of claim 1, wherein:

said actuating means comprises a plunger, said plunger being linearly movable in response to rotation of said cam structure.

6. The switch mechanism of claim 5, wherein:

said actuating means comprises a link connected between said cam structure and said plunger.

7. The switch mechanism of claim 1, wherein:

said first actuator portion comprises a first opening formed therein.

8. The switch mechanism of claim 1, wherein:

said second actuator portion comprises a second opening formed therein.

9. The switch mechanism of claim 1, wherein:

said first and second cam followers are spring loaded toward said first and second lobes, respectively.

10. The switch mechanism of claim 1, further comprising:

resilient means for inhibiting said cam structure from rotating about said first axis in response to insertion of said key into said support structure.

11. An interlock switch mechanism, comprising:

a key having a first actuator portion and a second actuator portion having a different length than said first actuator portion;

a support structure;

a cam structure having a first cam and a second cam, said first cam having a first lobe, said first cam being rotatably attached to said support structure, said first cam being rotatable about a first axis, said first lobe being shaped to receive an end of said first actuator portion, said second cam having a second lobe, said second cam being rotatably attached to said support structure, said second cam being rotatable about said first axis, said first and second cams being attached to each other, said first and second lobes being rotatably offset relative to each other, said second lobe being shaped to receive an end of said second actuator portion, said cam structure being rotatable about said first axis in response to contact of said end of said second actuator portion with said second lobe and in response to contact of said end of said first actuator portion with said first lobe;

a first cam follower rotatably attached to said support structure, said first cam follower being shaped to be received by said first lobe, said first cam being prevented from rotating about said first axis when said first cam follower is disposed within said first lobe;

a second cam follower rotatably attached to said support structure, said second cam follower being shaped to be received by said second lobe, said second cam being prevented from rotating about said first axis when said second cam follower is disposed within said second lobe;

first means for preventing said first cam follower from moving into said first lobe when said end of said first actuator portion is disposed within said first lobe;

second means for preventing said second cam follower from moving into said second lobe when said end of said second actuator portion is disposed within said second lobe; and means for actuating an electrical switch when said cam structure is rotated about said first axis by a predetermined arcuate distance, said second actuator portion being longer than said first actuator portion.

12. The switch mechanism of claim 11, wherein:

said first lobe is an opening formed in said first cam and said second lobe is an opening formed in said second cam.

13. The switch mechanism of claim 11, wherein:

said actuating means comprises a plunger, said plunger being linearly movable in response to rotation of said cam structure and said actuating means comprises a link connected between said cam structure and said plunger.

14. The switch mechanism of claim 11, wherein:

said first actuator portion comprises a first opening formed therein and said second actuator portion comprises a second opening formed therein.

15. The switch mechanism of claim 11, wherein:

said first and second cam followers are spring loaded toward said first and second lobes, respectively.

16. The switch mechanism of claim 11, further comprising:

resilient means for inhibiting said cam structure from rotating about said first axis in response to insertion of said key into said support structure.

17. An interlock switch mechanism, comprising:

a key having a first actuator portion and a second actuator portion having a different length than said first actuator portion;

a support structure;

a cam structure having a first cam and a second cam, said first cam having a first lobe, said first cam being rotatably attached to said support structure, said first cam being rotatable about a first axis, said first lobe being shaped to receive an end of said first actuator portion, said second cam having a second lobe, said second cam being rotatably attached to said support structure, said second cam being rotatable about said first axis, said first and second cams being attached to each other, said first and second lobes being rotatably offset relative to each other, said second lobe being shaped to receive an end of said second actuator portion, said cam structure being rotatable about said first axis in response to contact of said end of said second actuator portion with said second lobe and in response to contact of said end of said first actuator portion with said first lobe;

a first cam follower rotatably attached to said support structure, said first cam follower being shaped to be received by said first lobe, said first cam being prevented from rotating about said first axis when said first cam follower is disposed within said first lobe;

a second cam follower rotatably attached to said support structure, said second cam follower being shaped to be received by said second lobe, said second cam being prevented from rotating about said first axis when said second cam follower is disposed within said second lobe;

first means for preventing said first cam follower from moving into said first lobe when said end of said first actuator portion is disposed within said first lobe;

second means for preventing said second cam follower from moving into said second lobe when said end of said second actuator portion is disposed within said second lobe; and means for actuating an electrical switch when said cam structure is rotated about said first axis by a predetermined arcuate distance, said second actuator portion being longer than said first actuator portion, said first lobe being an opening formed in said first cam, said second lobe being an opening formed in said second cam.

18. The switch mechanism of claim 17, wherein:

said actuating means comprises a plunger, said plunger being linearly movable in response to rotation of said cam structure and said actuating means comprises a link connected between said cam structure and said plunger and said first actuator portion comprises a first opening formed therein and said second actuator portion comprises a second opening formed therein.

19. The switch mechanism of claim 17, wherein:

said first and second cam followers are spring loaded toward said first and second lobes, respectively.

20. The switch mechanism of claim 17, further comprising:

resilient means for inhibiting said cam structure from rotating about said first axis in response to insertion of said key into said support structure.

* * * * *